US009062838B1

(12) United States Patent
Merrill, Jr.

(10) Patent No.: US 9,062,838 B1
(45) Date of Patent: Jun. 23, 2015

(54) DOWNWARDLY-EXTENDING LIGHT FIXTURE

(71) Applicant: Jack K. Merrill, Jr., South Bend, IN (US)

(72) Inventor: Jack K. Merrill, Jr., South Bend, IN (US)

( * ) Notice: Subject to any disclaimer, the term of this patent is extended or adjusted under 35 U.S.C. 154(b) by 123 days.

(21) Appl. No.: 13/661,693

(22) Filed: Oct. 26, 2012

(51) Int. Cl.
*F21S 8/06* (2006.01)
*F21S 8/02* (2006.01)
*F21S 8/04* (2006.01)

(52) U.S. Cl.
CPC ... *F21S 8/026* (2013.01); *F21S 8/04* (2013.01)

(58) Field of Classification Search
CPC ..... F21S 8/06; F21S 8/026; F21S 8/04; F21S 8/02; F21S 2/005
USPC ..... 362/404
See application file for complete search history.

(56) References Cited

U.S. PATENT DOCUMENTS

| | | | | |
|---|---|---|---|---|
| 1,391,550 | A | 9/1921 | Lockhart | |
| 2,717,955 | A | 9/1955 | Schwemmer et al. | |
| 3,113,728 | A | 12/1963 | Boyd | |
| 3,906,846 | A | 9/1975 | Day | |
| 3,941,995 | A | 3/1976 | Fritz | |
| 3,974,584 | A | 8/1976 | Shorette | |
| 4,175,360 | A | 11/1979 | Mulvey | |
| 4,655,120 | A | 4/1987 | Lemmo | |
| 4,693,174 | A | 9/1987 | Anderson | |
| 4,858,520 | A | 8/1989 | Prochnow et al. | |
| 5,345,729 | A | 9/1994 | Prahst et al. | |
| 5,411,438 | A | 5/1995 | White et al. | |
| 6,179,451 | B1 | 1/2001 | Bodine et al. | |
| 6,769,785 | B1 | 8/2004 | Herst et al. | |
| 6,860,617 | B2 | 3/2005 | Fiene | |
| 7,338,182 | B1 | 3/2008 | Hastings et al. | |
| 7,547,112 | B2 | 6/2009 | Kim | |
| 7,922,351 | B2 | 4/2011 | Welker | |
| 7,971,680 | B2 * | 7/2011 | Morgan et al. | 181/205 |
| 2005/0024856 | A1 | 2/2005 | Helenowski | |
| 2006/0126330 | A1 * | 6/2006 | Yen | 362/253 |
| 2007/0246631 | A1 * | 10/2007 | Brown et al. | 248/343 |
| 2007/0279896 | A1 | 12/2007 | Engel | |
| 2010/0124062 | A1 | 5/2010 | Cercone | |
| 2010/0126090 | A1 * | 5/2010 | Liang et al. | 52/220.6 |
| 2011/0259665 | A1 | 10/2011 | Morgan, III et al. | |
| 2013/0223067 | A1 * | 8/2013 | Ito | 362/235 |

FOREIGN PATENT DOCUMENTS

JP 2010129212 A * 6/2010

* cited by examiner

*Primary Examiner* — Sean Gramling
*Assistant Examiner* — Gerald J Sufleta, II
(74) *Attorney, Agent, or Firm* — Botkin & Hall, LLP

(57) ABSTRACT

A lighting fixture formed having a housing, a lens and a luminaire. The housing having a wall extending between an upper end and a lower end. An upper flange circumscribing the wall and extending outwardly from the upper end of the housing. A lower flange inscribing the wall and inwardly extending from the lower end of the housing. The lens carried by the lower flange. The lighting fixture is carried by the upper flange, such as resting on the grid of a dropped ceiling. The luminaire is carried on an insert, with the insert resting above the upper flange.

9 Claims, 7 Drawing Sheets

36
14
34
10

42
16
18
22
26
30
12
24
20

DOWNWARDLY-EXTENDING LIGHT FIXTURE

BACKGROUND OF THE INVENTION

When constructing a building, attention must be directed to the design and placement of light fixtures. Overhead lighting is a key feature in many buildings. A common feature in building construction is the use of a dropped, or suspended, ceiling. A dropped ceiling is formed having a ceiling material, frequently formed from modular tiles arranged in a metal grid, suspended below the structural ceiling. The space between the dropped ceiling and the structural ceiling is called the plenum space. The plenum space is traditionally used to conceal piping, wiring, duct work, or other objects.

In a dropped ceiling, it is common for overhead light features to be incorporated in one of two ways (1) the light fixture is recessed into the plenum space with the base of the fixture flush with the dropped ceiling, or (2) the light fixture is suspended below the dropped ceiling, such as being suspended from the metal grid. The choice of which of the above two options to select for a given building is often dictated by what is carried within the plenum space. During construction of a building, it is common for the piping and duct work to be installed below the structural ceiling without regard to light placement in the building. As a result, it is common that in a location where the building designer would prefer to include a recessed light fixture this option is unavailable due to an obstruction, such as a pipe, in the plenum space. Such obstructions often force the building to be constructed using suspended light fixtures, even though recessed light fixtures may have been more aesthetically pleasing or specified in the building's design.

Recessed lighting is formed having a trim and a housing. The trim is the portion of the light fixture which is shown when installed. A lens is optionally carried on the trim to add aesthetic detail to the light or to aid in diffusing the light in the room. The housing is the portion of the light fixture which extends into the ceiling and carries the luminaires. The housing typically extends a minimum of 3 inches, and as much as 5 or more inches, into the ceiling to allow room for the luminaires to be concealed above the ceiling. In instances where an obstruction does not allow room for the recessed lighting housing, the current practice is to instead install a suspended light fixture which is mounted below the dropped ceiling. As such, there is a need for an improved lighting fixture.

SUMMARY OF THE INVENTION

The present disclosure describes an improved lighting fixture. The lighting fixture includes a housing formed by a wall which extends from a lower end to an upper end. An upper flange extends outwardly from the housing at the upper end. A lower flange extends inwardly from the housing at the lower end. A lens is carried on the lower flange. An insert carries a luminaire with the insert carried above the upper flange. The luminaire produces light which is emitted through the lens, such as for lighting a room. The lighting fixture of the present disclosure is suitable for being supported by the metal grid of a dropped ceiling, though applications apart from dropped-ceilings are contemplated.

BRIEF DESCRIPTION OF THE DRAWINGS

A preferred embodiment of this invention has been chosen wherein.

DESCRIPTION OF THE PREFERRED EMBODIMENT

Figure 1:
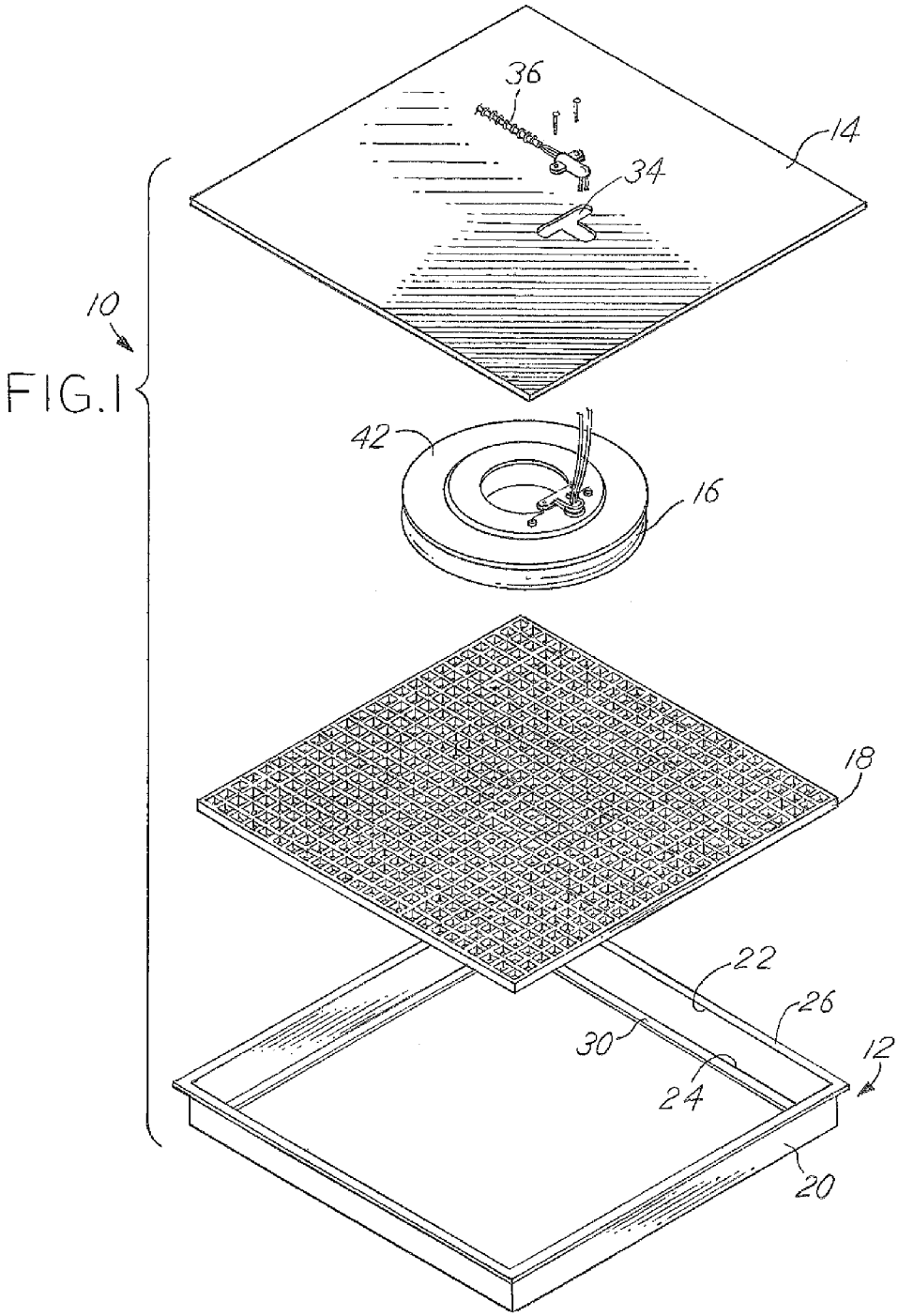
FIG. 1 is an exploded view of the lighting fixture of the present disclosure, showing the housing, the lens, the luminaire and the insert.

The present disclosure describes a lighting fixture 10. Referring now to FIG. 1, lighting fixture 10 is formed having a housing 12 and an insert 14. Insert 14 carries a luminaire 16. A lens 18 is optionally carried by housing 12.

Housing 12 is formed having a wall 20 which extends between an upper end 22 and a lower end 24 of housing 12. An upper flange 26 circumscribes, and extends outwardly from, wall 20 at upper end 22. Upper end 22 defines an upper opening of housing 12. A lower flange 30 inscribes, and extends inwardly from, wall 20 at lower end 24. Lower flange 30 defines a lower opening of housing 12. A chamber is an area within housing 12 defined by wall 20 and extends between lower opening and upper opening.

Insert 14 is a generally-planar panel which carries luminaire 16 and is supported above upper flange 26 of housing 12. Insert 14 preferably includes an aperture 34 to allow wiring 36 to pass through insert 14. Insert 14 preferably includes one or more eyelet 38 (see FIG. 7*a*) suitable for accepting a fastener (not shown), such fastener suitable for anchoring insert 14 to housing 12.

Luminaire 16 is a light-emitting object, such as incandescent bulb, fluorescent bulb, light-emitting diode (LED), or other light-emitting objects as are known in the art. Luminaires having various sizes, power requirements, lumen outputs, and specifications are suitable for use with the present disclosure. Without limiting the foregoing, any of a variety of fluorescent tubes are suitable for use herein, such as T12, T8, T5, T2 or T1. Insert 14 may carry a single luminaire, or multiple luminaires, depending on the desired brightness of light or lighting effect desired. When multiple luminaires 16 are present, they may be of a single type of light-emitting objects, or a combination of different types of light-emitting objects, as desired. Luminaire 16 extends from insert 14 into chamber of housing 12.

Luminaire 16 is connected to a power source, such as by wiring 36. In the preferred embodiment, luminaire 16 is joined to a luminaire fixture 42. Luminaire fixture 42 carries luminaire 16 and includes contacts for providing power from wiring 36 to luminaire 16. In the preferred embodiment, luminaire fixture 42 is mounted to insert 14.

Figure 2:
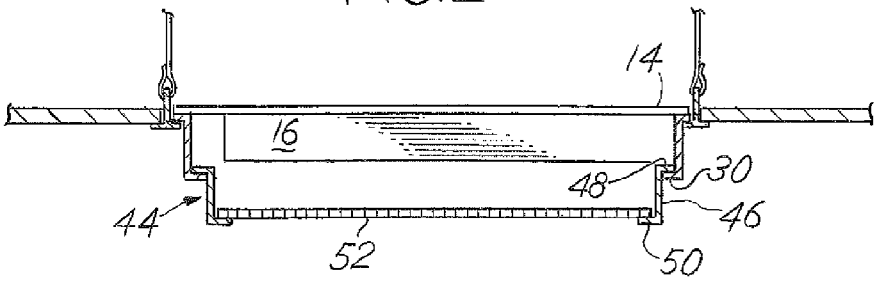
FIG. 2 is a sectional side view of the lighting fixture of FIG. 1 and including an extension member.

Referring now to FIG. 2, in one embodiment, an extension member 44 extends downwardly from lower flange 30 of housing 12. Extension member 44 is formed having a wall 46, an upper flange 48 and a lower flange 50, similar in construction to housing 12 described above. Extension member 44 is sized such that upper flange 48 of extension member 44 is carried on, and overlies, lower flange 30 of housing 12. A lens 52 is carried on lower flange 50 of extension member 44. The outer perimeter of upper flange 48 is shaped to match, or be slightly smaller than, the perimeter of lower flange 30 of housing 12, such that extension member 44 will be supported below housing 12. In one embodiment, wall 46 is shaped having a similar, but smaller-dimensioned, outer perimeter as wall 20 of housing 12. In another embodiment, wall 46 has a differently-shaped outer perimeter than wall 20 of housing 12, such as wall 20 being square in shape and wall 46 being round, but other shapes are anticipated.

Figure 3:
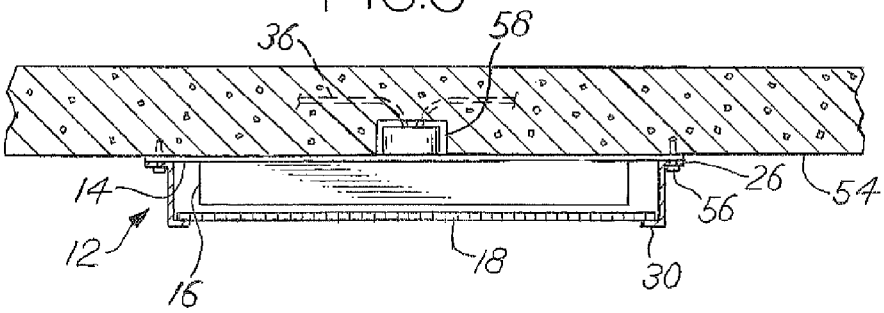
FIG. 3 is a sectional side view of the lighting fixture of FIG. 1 mounted to a structural ceiling.

Referring now to FIG. 3, in one embodiment, housing 12 is attached directly to the ceiling 54, such as by fasteners 56 mounted through eyelets formed in upper flange 26. In this embodiment, ceiling 54 includes a recess 58 for housing wiring 36. Luminaire 16 is mounted within housing 12 below ceiling 54. Lens 18 is carried on lower flange 30 of housing 12. Insert 14, if present, overlies upper flange 26 and includes an opening 34 allowing wiring 36 to enter recess 58.

Figure 4:
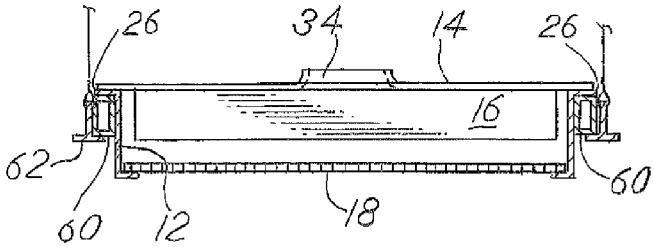
FIG. 4 is a sectional side view of the lighting fixture of FIG. 1 and including a spacer member.

Referring now to FIG. 4, in one embodiment a spacer 60 is used to offset upper flange 26 above metal grid 62. Here, upper flange 26 overlies spacer 60 and spacer 60 overlies metal grid 62. Spacer 60 preferably circumscribes housing 12. Spacer 60 may be used in combination with an extension member, such as the extension member shown in FIG. 2. Alternatively, spacer 60 is omitted and upper flange 26 is spaced intermediately between upper end 22 and lower end 24 of housing 12 to provide the same effect as the use of spacer 60. In an alternative embodiment, a series of discrete spacers are used in place of the monolithic spacer described above, such discrete spacers are spaced around housing 12 to offset upper flange 26 above metal grid 62.

Figure 5:
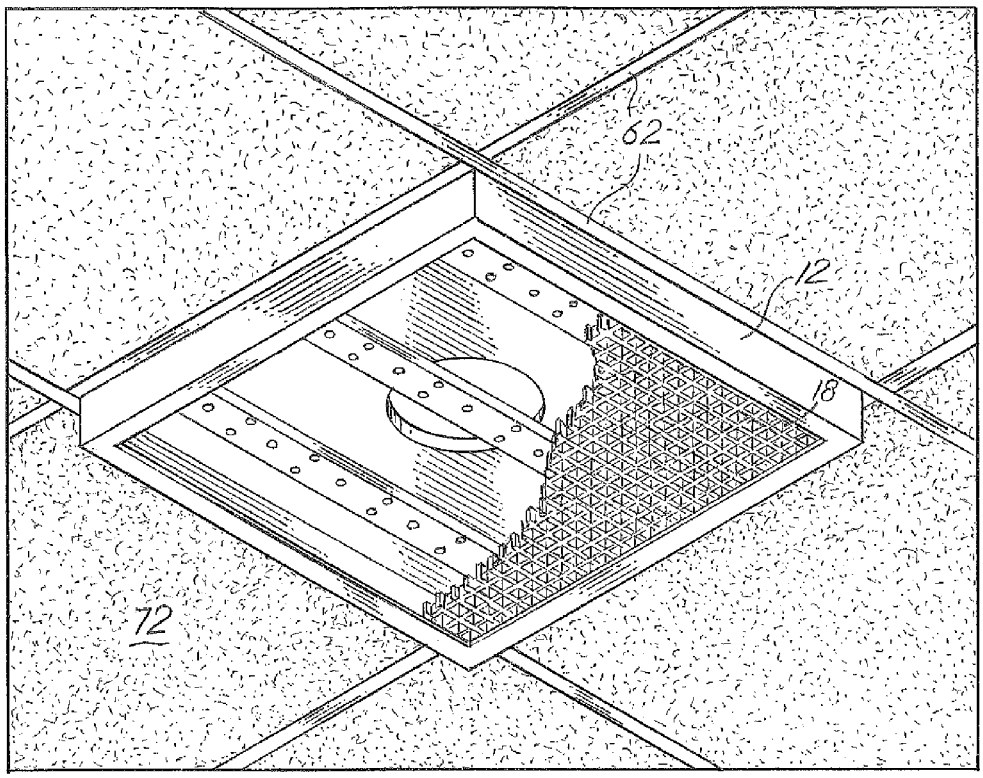
FIG. 5 is a perspective view from below of the lighting fixture carried on the grid of a dropped ceiling with lens cutaway.

Referring now to FIG. 5, one embodiment of lighting fixture 10 is shown as mounted in a dropped ceiling. Housing 12 is carried at upper flange 26 (not shown) by grid 62. Lens 18 is shown cutaway to show insert 14 and luminaire 16, here luminaire 16 is shown as a series of LED strips. As shown in FIG. 5, lighting fixture 10 extends downwardly from grid 62.

Figure 6:
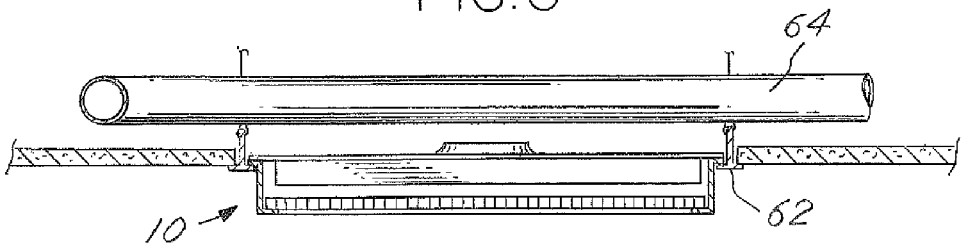
FIG. 6 is a sectional side view of the lighting fixture with an obstruction located above the fixture.

FIG. 6 shows one advantage of the lighting fixture of the present disclosure. Here, a pipe 64 obstructs the area directly above lighting fixture 10. The positioning of pipe 64 prevents use of a standard recessed lighting fixture. Here, lighting fixture 10 extends below grid 62 to allow the lighting to be installed below pipe 64.

Figure 7A:
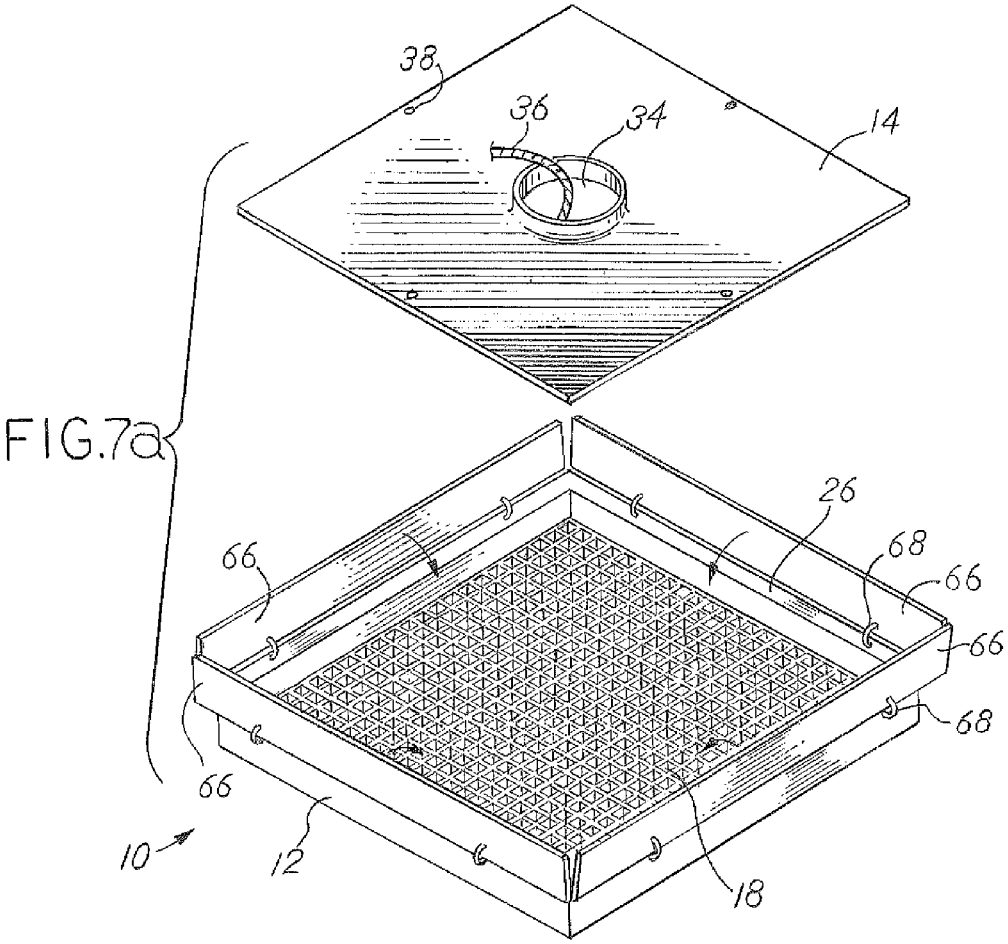
FIG. 7*a* is an exploded view of the lighting fixture and includes flaps attached to the housing, with the flaps in the opened position.
Figure 7B:
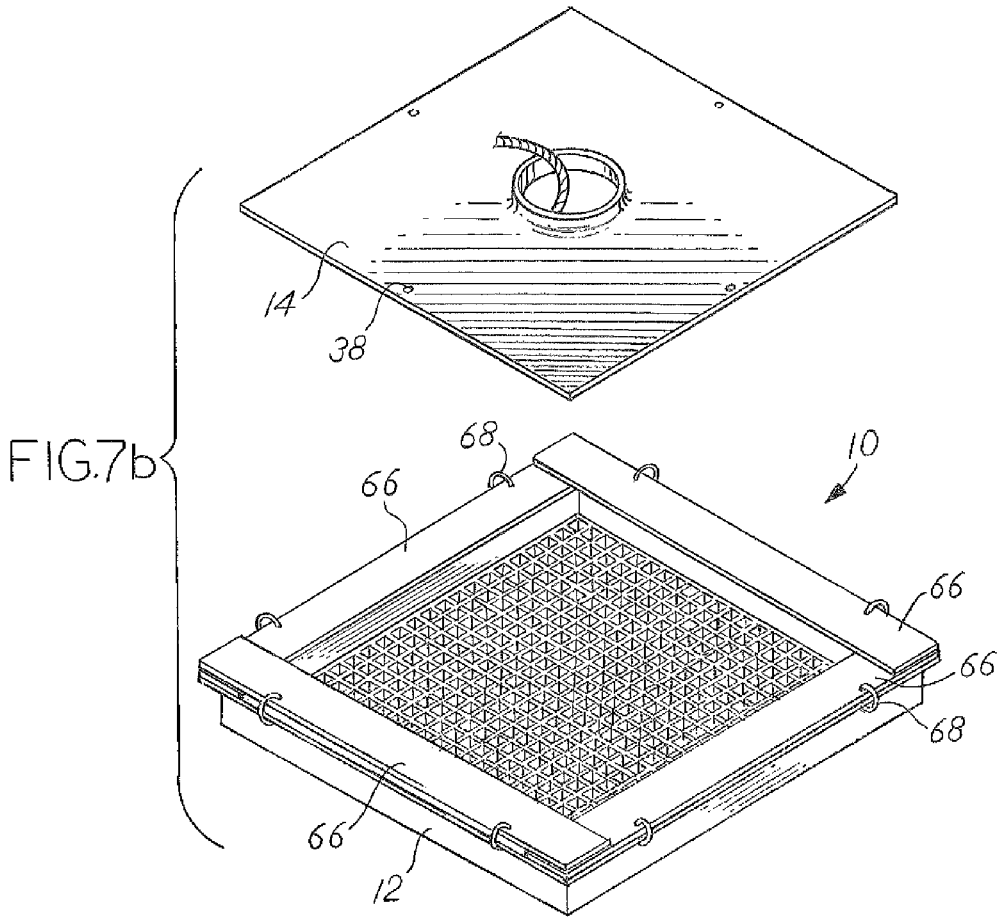
FIG. 7*b* is an exploded view of the lighting fixture of FIG. 7*a* with the flaps in the closed position.
Figure 7C:
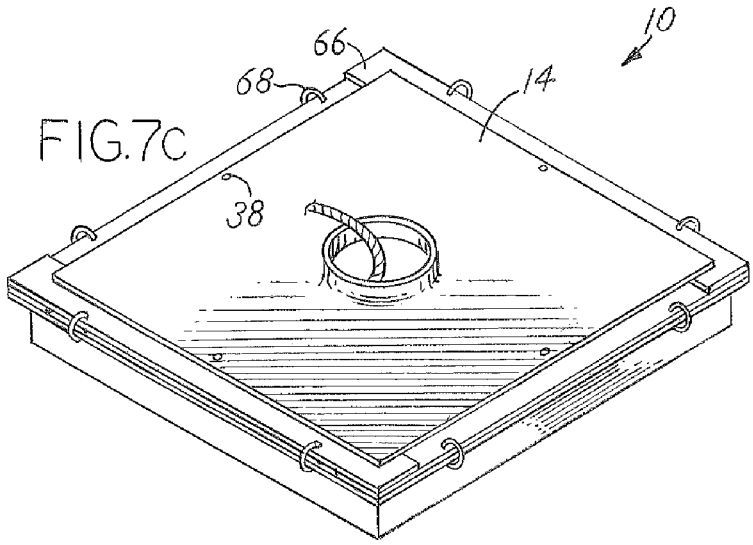
FIG. 7*c* is a perspective view of the lighting fixture of FIG. 7*a* with the insert overlying the flaps.

FIGS. 7*a*-7*c* show an exploded view of another embodiment, where lighting fixture 10 includes flaps 66 attached to upper flange 26 by hinges 68. Flaps 66 are rotatable about hinges 68 such that they are moveable from an opened position to a closed position (FIG. 7*a* showing flaps 66 in the opened position, FIG. 7*b* showing flaps 66 in the closed position). Insert 14 overlies flaps 66 when flaps 66 are in the closed position, as shown in FIG. 7*c*. Lens 18 overlies lower flange 30 (not shown) of housing 12, with lens 18 removable from housing 12 when flaps 66 are in the open position.

FIG. 7*b* shows flaps 66 in the closed position. Insert 14 overlies flaps 66 when flaps 66 are in the closed position, as shown in FIG. 7*c*. Insert 14 preferably includes one or more eyelets 38 for accepting a fastener for anchoring insert 14 to housing 12. Luminaire 16 (not shown) is spaced inwardly from the perimeter edge of insert 14 such that luminaire 16 fits within the frame formed by flaps 66 when in the closed position.

Figure 8:
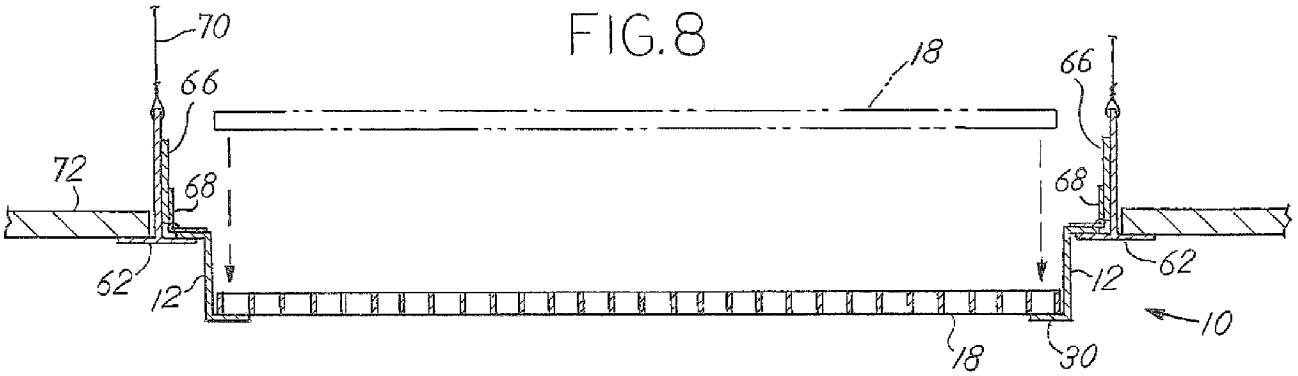
FIG. 8 is a sectional side view of the lighting fixture of FIG. 7*a* with the flaps in the opened position and showing the lens being inserted.
Figure 9:
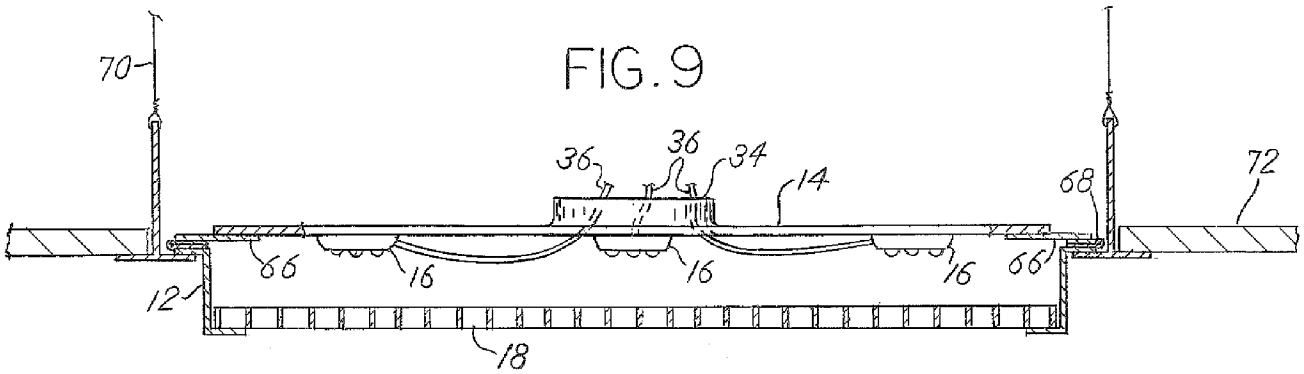
FIG. 9 is a sectional side view of the lighting fixture of FIG. 8 with the flaps in the closed position and the insert overlying the flaps.

FIGS. 8 and 9 show how fixture 10 of FIGS. 7*a*-7*c* is assembled. As shown in FIG. 8, housing 12 is suspended from grid 62 with flaps 66 in the opened position. With flaps 66 in the opened position, lens 18 is inserted through the upper opening of housing 12. In an alternative embodiment, lower opening of housing 12 is openable such that lens 18 is insertable from the lower side of housing 12. With lens 18 overlying lower flange 30, flaps 66 are rotated to the closed position, as shown in FIG. 9. Insert 14 overlies flaps 66. Wiring 36 passes through opening 34 and is connected to a power source to provide electricity to luminaires 16.

Hinges 68 facilitate flaps 66 rotating between an opened position and a closed position. Hinges 68 are of any type known in the art suitable for supporting flaps 66. Suitable hinges may include piano hinges, rings or ties (such as made from metal, plastic or similar suitable materials), cabinet hinges, living hinges (such as if flap 66 and upper flange 26 are formed from a single piece of polymer and separated by a thinned hinged section), or other hinges known in the art.

Lens 18, as described herein, is optional. Lighting fixture 10 may be used with or without a lens 18, and any mention of lens 18 should not be read as limiting. Where used, lens 18 is used to add aesthetic value to lighting fixture 10 or to help propagate or focus the light emanating from luminaire 16. Any prior art lens is suitable for use with lighting fixture 10. In one embodiment, lens 18 is colored with an artistic print, such that when light passes through the lens, the print is illuminated while also allowing light to illuminate the area around the light fixture. Where lens 18 is omitted, lower flange 30 may also be omitted.

Figure 10:
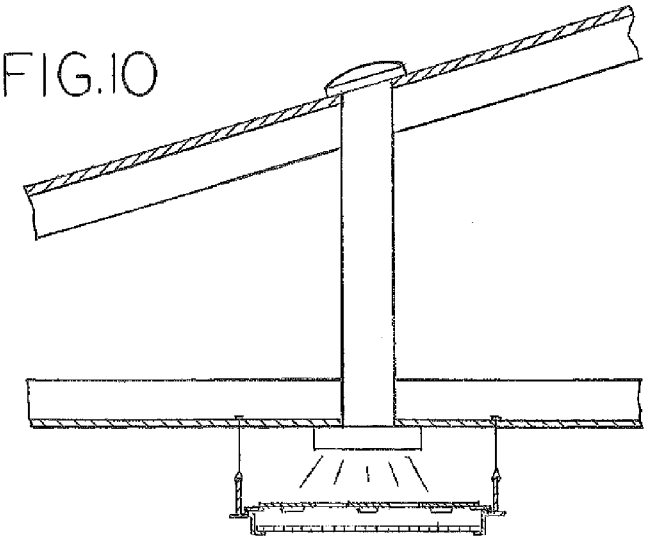
FIG. 10 is a sectional side view of the lighting fixture incorporating light emitted by a natural light source.
Figure 11:
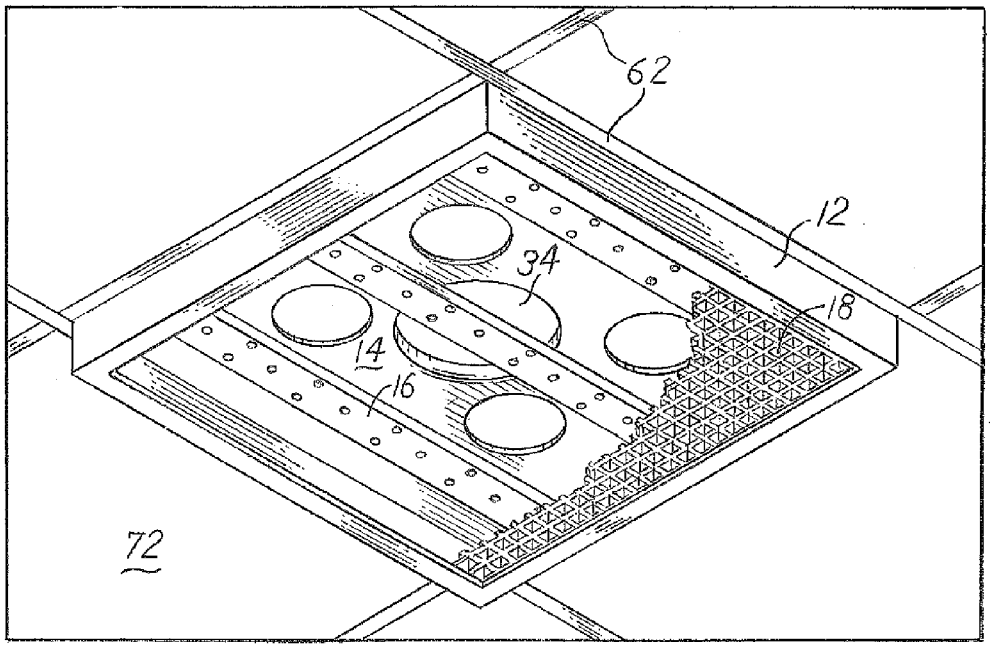
FIG. 11 is a perspective view from below of the lighting fixture of FIG. 10.

In one embodiment shown in FIGS. 10 and 11, insert 14 includes an auxiliary opening to allow natural light to enter lighting fixture 10. In this way, lighting fixture 10 allows natural light to enter the building, and supplemental light from a luminaire can be either used in combination with the natural light, or used when no natural light is available. The natural light may be introduced through the auxiliary opening in any suitable way, such as directly from above, through a sky-light, through a series of reflectors from a natural light source, or other suitable means as is known in the art. FIG. 10 shows one such example where natural light passes through a sky light 76 formed in a roof to lighting fixture 10, in this say lighting fixture 10 is suitable for emitting either natural light, light from a luminaire, or both.

Housing 12 is preferably monolithic, having a single piece of material forming wall 20, upper flange 26 and lower flange 30. In another embodiment, upper flange 26 and lower flange 30 are joined to wall 20, such as with fasteners or by welding.

In the preferred embodiment, wall 20 is a solid member. In an alternative embodiment, wall 20 is formed having openings to allow light to escape housing 12 from both lower opening and from the openings in wall 20. In one embodiment, one or more luminaires are mounted proximate the openings in wall 20.

Drop ceilings are well known in the art. The common configuration includes a metal grid 62 suspended below a structural ceiling, such as by wires 70 (see FIGS. 8 and 9).

Grid 62 is formed from a series of lateral and transverse members which together form openings in grid 62. In cross-section, grid 62 is shaped as an upside-down "T." Each side of the "T" is a flange for carrying a tile 72, a light fixture, a vent, or other object as is known in the art. Traditionally, each flange of the "T" of grid 62 is 0.25-0.50 inches wide, and as a result, upper flange 26 is of similar dimensions, 0.25-0.50 inches wide. The benefit of flaps 66 is that they provide a larger area upon which insert 14 rests, to allow for lower tolerances in manufacture, as compared to resting insert 14 directly on upper flange 26. Lighting fixture 10, as described herein, is preferably sized to fit a standard-sized metal grid, such as in a 2'×2' or 2'×4' grid. However, the dimensions of lighting fixture 10 can readily be customized to fit any sized grid.

One advantage of the lighting fixture of the present disclosure is that the fixture can be spaced below any obstacles present in the plenum space. As such, in the preferred embodiment, the luminaire will be positioned at or below the metal grid, which is an improvement over the prior art. Another advantage of the lighting fixture described herein is use of the insert. Insert 14 is designed to be "hot-swappable" in and out of light fixture 10. As such, if one of the luminaires or ballasts of insert 14 fails, the entire insert can be quickly replaced with a new insert, decreasing downtime. Further, if new types of luminaires are desired, rather than replacing the ballast, as is required with traditional lighting fixtures, the insert can be quickly replaced, again, decreasing downtime. As such, insert represents a significant improvement over prior art lighting fixtures.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A lighting fixture adapted to mate with a ceiling grid comprising a series of T-shaped rails, said grid having openings formed from opposing T-shaped rails each having an upstanding separating portion intersecting a mating portion, said separating portion having an upper edge spaced from said mating portion to define a height, said mating portion having an upper surface with a width defined by the distance between a lateral edge of said mating portion and the intersection between said separating portion and said mating portion, said fixture comprising:

a housing having upstanding walls having an upper end and a lower end, adjacent upstanding walls intersecting to form a continuous perimeter wall, said housing including an upper flange having an upper and lower surface, said upper flange extending outwardly from said upper end of said upstanding walls thereby extending outwardly of said perimeter wall, said upper flange having an outer edge, a lower flange having an upper surface and a lower surface, said lower flange extending inwardly from said lower end of said upstanding walls, said lower flange having an inner edge inward of said perimeter wall, said upper flange substantially parallel to and fixed with respect to said lower flange;

an insert having lateral edges and a perimeter defined by intersecting lateral sides, said insert having an upper surface and a lower surface, said insert including a luminaire affixed to and extending below said lower surface, said insert including an aperture;

a diffusing lens having lateral edges and a perimeter defined by intersecting lateral sides, said perimeter of said diffusing lens fittable within said continuous perimeter wall, said lens overlaying a portion of said upper surface of said lower flange, said insert overlaying a portion of said upper surface of said upper flange, said upstanding walls encircling said luminaire and said diffusing lens;

said upper surface of said insert located below said upper edge of said separating portion when said lower surface of said upper flange overlays a portion of said upper surface of said mating portion and said perimeter of said insert is adjacent to said separating portion.

2. The lighting fixture of claim 1, the distance between opposing upstanding walls being less than said width of said upper surface of said mating portion such that said upstanding walls protrude below a lower surface of said mating portion when said lower surface of said upper flange overlays a portion of said grid.

3. The lighting fixture of claim 2, said housing being formed from an opaque material.

4. The lighting fixture of claim 3, said diffuser retained between said upper flange and said lower flange when said lower surface of said insert overlays said upper surface of said upper flange.

5. The lighting fixture of claim 1, said insert including an aperture located interiorly from said perimeter and allowing light to pass from said upper surface to said lower surface said insert.

6. The lighting fixture of claim 1, and a spacer having and upper surface separated from a lower surface by a distance, said spacer encircling said upstanding walls, said upper surface adapted to overlay said lower surface of said upper flange, said lower surface adapted to overlay a portion of said ceiling grid.

7. The lighting fixture of claim 6, said upstanding walls including an aperture adapted to allow light to pass therethrough, said aperture located between an inside surface and an outside surface of said upstanding walls.

8. The lighting fixture of claim 7, the distance between opposing upstanding walls being less than said width of said upper surface of said mating portion such that said upstanding walls protrude below a lower surface of said mating portion when said lower surface of said upper flange overlays a portion of said grid.

9. The lighting fixture of claim 1, said housing being formed from an opaque material.

* * * * *